US009604765B2

(12) United States Patent
Besic

(10) Patent No.: US 9,604,765 B2
(45) Date of Patent: Mar. 28, 2017

(54) LOCKING CAP DEVICE AND METHODS

(71) Applicant: Igor Besic, Sombor (RS)

(72) Inventor: Igor Besic, Sombor (RS)

(73) Assignee: AHHMIGO, LLC, New York, NY (US)

( * ) Notice: Subject to any disclaimer, the term of this patent is extended or adjusted under 35 U.S.C. 154(b) by 332 days.

(21) Appl. No.: 14/209,370

(22) Filed: Mar. 13, 2014

(65) Prior Publication Data

US 2014/0263313 A1 Sep. 18, 2014

Related U.S. Application Data

(60) Provisional application No. 61/782,694, filed on Mar. 14, 2013.

(51) Int. Cl.
*B65D 51/28* (2006.01)

(52) U.S. Cl.
CPC ..... *B65D 51/2828* (2013.01)

(58) Field of Classification Search
CPC ..... B65D 51/2828; B65D 25/08; B67D 7/06
USPC ..... 220/200, 278, 277; 215/296, 297, 316, 215/329
See application file for complete search history.

(56) References Cited

U.S. PATENT DOCUMENTS

| | | | |
|---|---|---|---|
| 3,521,745 | A | 7/1970 | Schwatrzman |
| 3,603,169 | A | 9/1971 | Fandetti |
| 3,968,872 | A | 7/1976 | Cavazza |
| 4,193,731 | A | 3/1980 | Blatt et al. |
| 4,195,731 | A | 4/1980 | Cavazza |
| 4,648,532 | A | 3/1987 | Green |
| 4,858,760 | A | 8/1989 | Di Sturco |
| 4,982,875 | A | 1/1991 | Pozzi et al. |
| 5,038,951 | A | 8/1991 | Rizzardi |
| 5,135,137 | A | 8/1992 | Rudick |
| 5,147,613 | A | 9/1992 | Heilmann et al. |
| 5,246,142 | A | 9/1993 | DiPalma et al. |
| 5,482,170 | A | 1/1996 | Semersky et al. |
| 5,671,770 | A | 9/1997 | Rusche et al. |
| 5,772,017 | A | 6/1998 | Kang |
| 5,941,380 | A | 8/1999 | Rothman |
| 5,971,140 | A | 10/1999 | Frutin |

(Continued)

FOREIGN PATENT DOCUMENTS

| | | | |
|---|---|---|---|
| EP | 0838161 | A2 | 4/1998 |
| EP | 1210880 | A1 | 6/2002 |

(Continued)

OTHER PUBLICATIONS

The Rising Beverage Company LLC, "Activate"; http://activatedrinks.com/#/activate; 2014; Los Angeles, CA.

(Continued)

*Primary Examiner* — Anthony Stashick
*Assistant Examiner* — Raven Collins
(74) *Attorney, Agent, or Firm* — VLP Law Group LLP; Jeremy A. Cubert

(57) ABSTRACT

A cap device and methods for use with a container are provided. The cap device can include a piercer cover and a shell for comprising a composition. The piercer cover has one or more side walls comprising one or more piercers attached to the top wall and disposed toward the bottom portion of the piercer cover for breaking a film covering the bottom portion of the shell.

8 Claims, 9 Drawing Sheets

(56) References Cited

U.S. PATENT DOCUMENTS

| | | | |
|---|---|---|---|
| 6,045,254 | A | 4/2000 | Inbar et al. |
| 6,076,704 | A | 6/2000 | Weiler et al. |
| 6,098,795 | A | 8/2000 | Mollstam et al. |
| 6,152,296 | A | 11/2000 | Shih |
| 6,159,513 | A | 12/2000 | Judlowe et al. |
| 6,161,728 | A | 12/2000 | Dark |
| 6,165,523 | A | 12/2000 | Story |
| 6,250,346 | B1 | 6/2001 | Castillo |
| 6,263,923 | B1 | 7/2001 | Castillo |
| 6,305,576 | B1 | 10/2001 | Leoncavallo |
| D452,818 | S | 1/2002 | Berman |
| 6,372,270 | B1 | 4/2002 | Denny |
| 6,378,730 | B1 | 4/2002 | Reddy et al. |
| 6,412,526 | B2 | 7/2002 | Castillo |
| 6,513,650 | B2 | 2/2003 | Mollstam et al. |
| 6,533,113 | B2 | 3/2003 | Moscovitz |
| 6,540,070 | B1 | 4/2003 | Conwell |
| 6,584,595 | B2 | 6/2003 | Cypher |
| 6,598,757 | B2 | 7/2003 | Stillinger et al. |
| 6,609,612 | B2 | 8/2003 | Vlodek |
| 6,702,161 | B2 | 3/2004 | Adams et al. |
| 6,704,591 | B2 | 3/2004 | Sakaida |
| 6,760,640 | B2 | 7/2004 | Suttile et al. |
| 6,772,910 | B1 | 8/2004 | Coory |
| 6,779,210 | B1 | 8/2004 | Kelly |
| 6,786,330 | B2 | 9/2004 | Mollstam et al. |
| 6,854,595 | B2 | 2/2005 | Kiser |
| 6,886,686 | B2 | 5/2005 | Anderson |
| 6,934,983 | B1 | 8/2005 | Johnston |
| 6,935,493 | B2 | 8/2005 | Cho |
| 6,959,839 | B2 | 11/2005 | Roth et al. |
| 6,971,548 | B2 | 12/2005 | Smith |
| 7,010,877 | B2 | 3/2006 | Geary |
| 7,172,095 | B2 | 2/2007 | Marshall |
| 7,185,775 | B1 | 3/2007 | Decal |
| 7,195,374 | B2 | 3/2007 | Saccomanno et al. |
| 7,219,796 | B2 | 5/2007 | Anderson |
| 7,229,658 | B1 | 6/2007 | Inoue et al. |
| 7,249,690 | B2 | 7/2007 | Smith et al. |
| 7,259,690 | B1 | 8/2007 | Furmidge et al. |
| 7,261,226 | B2 | 8/2007 | Adams et al. |
| 7,306,117 | B2 | 12/2007 | Roth et al. |
| 7,308,915 | B2 | 12/2007 | Johns et al. |
| 7,337,921 | B2 | 3/2008 | Ma |
| 7,357,277 | B2 | 4/2008 | Verespej et al. |
| 7,475,774 | B2 | 1/2009 | Clarkson |
| 7,490,719 | B2 | 2/2009 | Parker |
| 7,503,453 | B2 | 3/2009 | Cronin et al. |
| 7,506,782 | B2 | 3/2009 | Walters et al. |
| 7,530,469 | B2 | 5/2009 | Naesje |
| 7,568,576 | B2 | 8/2009 | Sweeney, Jr. et al. |
| 7,591,938 | B2 | 9/2009 | Barlag et al. |
| 7,607,549 | B2 | 10/2009 | Morini |
| 7,607,555 | B2 | 10/2009 | Smith |
| 7,740,134 | B2 | 6/2010 | Sweeney, Jr. et al. |
| 7,854,104 | B2 | 12/2010 | Cronin et al. |
| 7,886,899 | B2 | 2/2011 | Frutin |
| 7,901,960 | B2 | 3/2011 | Ishibashi et al. |
| 7,971,739 | B2 | 7/2011 | Ammann |
| 7,980,424 | B2 | 7/2011 | Johnson |
| 8,016,159 | B2 | 9/2011 | Ma |
| 8,070,014 | B2 | 12/2011 | Wisniewski |
| 8,138,162 | B2 | 3/2012 | Kannar et al. |
| 8,152,017 | B2 | 4/2012 | Lizerbram et al. |
| 8,230,777 | B2 | 7/2012 | Anson et al. |
| D666,908 | S | 9/2012 | Dabah et al. |
| 8,276,748 | B2 | 10/2012 | Nyambi et al. |
| 8,297,456 | B1 | 10/2012 | Anderson |
| 8,356,711 | B2 | 1/2013 | Canziani Hoffa et al. |
| 8,367,140 | B2 | 2/2013 | Fukuda et al. |
| 8,372,328 | B2 * | 2/2013 | Dubach ..... B29C 45/006 215/225 |
| 8,376,175 | B2 | 2/2013 | Gonzalez |
| 8,408,389 | B1 | 4/2013 | Anderson |
| 8,418,302 | B1 | 4/2013 | Suen |
| 8,443,970 | B2 | 5/2013 | Coon |
| 8,613,372 | B2 | 12/2013 | Porter |
| 2002/0066677 | A1 | 6/2002 | Moscovitz |
| 2003/0017236 | A1 | 1/2003 | Makita et al. |
| 2003/0072850 | A1 | 4/2003 | Burniski |
| 2004/0007481 | A1 | 1/2004 | Kiser, Jr. |
| 2004/0200742 | A1 | 10/2004 | Cho |
| 2005/0173271 | A1 | 8/2005 | Levi |
| 2005/0236424 | A1 | 10/2005 | Walters et al. |
| 2005/0279653 | A1 | 12/2005 | Williams-Lucas et al. |
| 2006/0006077 | A1 | 1/2006 | Mosher et al. |
| 2006/0051494 | A1 | 3/2006 | Muller et al. |
| 2006/0118435 | A1 | 6/2006 | Cronin et al. |
| 2006/0131327 | A9 | 6/2006 | Cabelli |
| 2007/0023299 | A1 | 2/2007 | Clarkson |
| 2007/0074979 | A1 | 4/2007 | Cho |
| 2007/0108153 | A1 | 5/2007 | Weist |
| 2007/0158312 | A1 | 7/2007 | Wang et al. |
| 2007/0163985 | A1 | 7/2007 | Morini |
| 2007/0281054 | A1 | 12/2007 | Boff et al. |
| 2008/0105639 | A1 | 5/2008 | Musetti |
| 2008/0179331 | A1 | 7/2008 | Sharp |
| 2008/0202950 | A1 | 8/2008 | Anderson |
| 2008/0223485 | A1 | 9/2008 | Nyambi et al. |
| 2008/0223741 | A1 | 9/2008 | Nyambi et al. |
| 2009/0017146 | A1 | 1/2009 | Shevach |
| 2009/0110789 | A1 | 4/2009 | Mower et al. |
| 2009/0139882 | A1 | 6/2009 | DeJonge |
| 2009/0139951 | A1 * | 6/2009 | Chen ..... B65D 51/2835 215/227 |
| 2009/0223921 | A1 | 9/2009 | Enghard |
| 2009/0255929 | A1 | 10/2009 | Abercrombie, III et al. |
| 2009/0308831 | A1 | 12/2009 | Anderson |
| 2010/0025268 | A1 | 2/2010 | Lee et al. |
| 2010/0078438 | A1 | 4/2010 | Lee et al. |
| 2010/0163442 | A1 | 7/2010 | Lee et al. |
| 2011/0108442 | A1 | 5/2011 | Cho |
| 2011/0163119 | A1 | 7/2011 | Nyambi et al. |
| 2011/0266170 | A1 | 11/2011 | Ligon |
| 2011/0269802 | A1 | 11/2011 | Ligon |
| 2011/0278185 | A1 | 11/2011 | Aguadisch et al. |
| 2011/0283665 | A1 | 11/2011 | Guglielmini et al. |
| 2012/0085761 | A1 | 4/2012 | Gonzalez |
| 2012/0152951 | A1 | 6/2012 | Gonzalez |
| 2012/0193249 | A1 | 8/2012 | Lizerbram et al. |
| 2012/0199503 | A1 | 8/2012 | Dyrbye et al. |
| 2012/0217178 | A1 | 8/2012 | Rohr et al. |
| 2012/0228313 | A1 | 9/2012 | Wang |
| 2012/0255952 | A1 | 10/2012 | Knierbein et al. |
| 2012/0321745 | A1 | 12/2012 | Juga et al. |
| 2012/0325769 | A1 | 12/2012 | Essebaggers et al. |
| 2013/0029015 | A1 | 1/2013 | Susbielles Repetto |
| 2013/0095213 | A1 | 4/2013 | Walters |
| 2013/0126730 | A1 | 5/2013 | Khursheed et al. |

FOREIGN PATENT DOCUMENTS

| | | | |
|---|---|---|---|
| EP | 1551239 | A1 | 7/2005 |
| EP | 1690457 | A1 | 8/2006 |
| EP | 1817965 | A1 | 8/2007 |
| EP | 2143344 | A1 | 1/2010 |
| EP | 2186418 | A1 | 5/2010 |
| WO | 2013173470 | A1 | 11/2013 |

OTHER PUBLICATIONS

Karma Culture LLC, "Karma Wellness Water"; http://www.drinkkarma.com/, 2014; Pittsford, NY.

Blastmax, Malin Haley DiMaggio and Bowen PA, "Blastmax"; http://blastmax.com/; Ft Lauderdale FL.

Viz Enterprises LLC, "What is VIZ?"; http://www.vizdrink.com/vizhome.html; 2008; USA.

New York Spring Water, "New York Spring Water "; http://www.newyorkspringwater.com/; New York.

Vicapsystems Ltd., "The World's Only Dispenser Sports Cap System"; http://www.vicapsystems.com/ ; 2013; Switzerland.

(56) References Cited

OTHER PUBLICATIONS

Steeman, Anton, "Developments in Dispensing Caps—An Overview"; http://bestinpackaging.com/2012/03/05/developments-in-dispensing-caps-an-overview/; 2012; USA.
Steeman, Anton, "Developments in Dispensing Caps—An Overview 03"; http://bestinpackaging.com/2012/03/22/developments-in-dispensing-caps-an-overview-03/; 2012; USA.
Tea of a Kind, "The Gizmo Innovation—Goodness Preserved"; http://www.teaofakind.com/products/the-gizmo-innovation; 2012; USA.

* cited by examiner

LOCKING CAP DEVICE AND METHODS

PRIORITY CLAIM

This application claims priority to U.S. Provisional Patent Application Ser. No. 61/782,694, filed Mar. 14, 2013. The above referenced application is incorporated herein by reference as if restated in full.

BACKGROUND

There are many beverages sold in the market that are compositions of one or more ingredients, usually a liquid and one or more solid perishable ingredients. Often, these ingredients have a short shelf life and must be refrigerated. Compositions can be stored without refrigeration if they have been pasteurized, but the pasteurization process destroys the freshness as well as the nutritional quality of the perishable ingredients. In order to preserve the freshness and nutritional quality, the perishable ingredients can be dehydrogenated and kept separate from the liquid component until shortly before use by a consumer, at which point they are combined. In order to keep the dehydrogenated components and liquid component separate while maintaining the convenience and unity of the product, the dehydrogenated component can be kept in a cap while the liquid component is stored in a bottle or other container.

SUMMARY

One aspect provides a cap device comprising a piercer cover, and a shell for associating or attaching to a container. In one aspect, the shell contains a composition. In another aspect, the piercer cover contains a composition. The composition may include one or more of the following: camu, camu berry, manoic root, acerola berry, amla berry, buckwheet berry sprouts, blueberry, raspberry, cranberry, cherry, rose hips, lemon peel, black pepper, algae, *spirulina*, klamath, *chlorella, dunaliella*, kelp, wakame, kombu, bladderwrack, dulse, laver, millet sprouts, *quinoa* sprouts, broccoli sprouts, apple, green papaya, enzymes, amylase, cellulase, lipase, protease, mushrooms, reishi, shiitake, maitake, *agraricus, cordyceps, astragalus* root, eleuthero root, *lycium* berry, *angelica* sinensis root, schizandara berry, bai-zhu *atractylodes* rhizome, fo-ti root, paeonia lactiflor root, *rehmannia* root, *codonopsis* root, licorice root, jujube fruit, jojoba berry, poria, ginger, ginger rhizome, tangerine peel, *polygala* root, *ligusticum wallichii* rhizome, wheat grass, barley grass, oat grass, alfalfa grass, spinach leaf, parsley leaf, kale leaf, collard leaf, nettle leaf, red clover flower, skullcap flower, skullcap leaf, burdock root, *ginkgo* leaf, yellow dock root, dandelion leaf, rosemary leaf, clove bud, sage leaf, natural vitamin E sunflower, and chia seed. The composition can also comprise additives for cosmetics or other consumer products (e.g., shampoo, conditioner).

In one aspect, the piercer cover comprises one or more side walls, a top wall, and a bottom portion. In another aspect, the one or more side walls comprise one or more piercers attached to the top wall and disposed toward the bottom portion of the piercer cover. In yet another aspect, the one or more cutting elements are disposed on the ends of the one or more piercers. The one or more cutting elements can be made of any suitable material, such as metal or plastic, and can be of any shape, such as triangular, square, or diamond. The one or more cutting elements can be either sharp or blunt.

In one aspect, the piercer cover comprises a cover skirt. In another aspect the cover skirt covers the shell. The piercer cover can be opaque, transparent, or partially transparent, and made of any suitable material.

In one aspect, the shell comprises one or more side walls, and a bottom portion. The bottom portion can be covered by any suitable material, such as a film. The film can be either thick or thin, made of plastic or metal, or any combination of plastic and metal and thick and thin materials. In another aspect, the bottom portion of the shell is sloped. In one aspect, the shell comprises a tamper evident band. In one aspect, the piercer cover and container are manufactured separately.

In one aspect, there is an opening between one or more side walls of the shell and one or more sidewalls of the piercer cover, so that the piercer cover is in communication with the shell. In another aspect, there are several openings, each opening formed by one or more side walls of the piercer cover and one or more side walls of the shell.

In one aspect, the piercer cover comprises threads disposed on the one or more side walls. In another aspect, the piercer cover comprises locks disposed on the one or more side walls. In yet another aspect, the piercer cover comprises two sets of locks disposed on the one or more side walls, where a first set of locks is disposed closer to the top wall of the piercer cover than a second set of locks. In yet another aspect, the piercer cover comprises beads disposed on one or more side walls. In yet another aspect, the piercer cover comprises one or more seal rings disposed on the one or more side walls.

In one aspect, the shell comprises threads disposed on the one or more side walls. In this aspect, threads on the shell can be adapted to engage with threads on the piercer cover by rotating the piercer cover. In another aspect, threads on the shell can be adapted to engage with threads on the mouth of a container by rotating the shell. In one aspect, the threads on the shell can be disposed on the inside of the one or more side walls of the shell and adapted to engage with the threads of the container disposed on the outside of the container. In another aspect, the threads of the shell can be disposed on the outside of the one or more side walls of the shell and adapted to engage with threads disposed on the inside of the container. In yet another aspect, the threads of the piercer cover can be disposed on the inside of the one or more side walls of the piercer cover and adapted to engage with threads disposed on the outside of the container.

In one aspect, the shell comprises locks disposed on the one or more side walls. In yet another aspect, the shell comprises beads disposed on the one or more side walls. In yet another aspect, the shell comprises one or more seal rings disposed on the one or more side walls.

During actuation, one or more piercers may break the film. In this aspect, the shell is in communication with the container and the composition can flow or move through the bottom portion of the shell into the container. The film can be broken by puncturing, cutting, or any other suitable means. In one aspect, actuation can occur by manually pressing down on the top wall of the piercer cover with a finger, thumb, or any other suitable means, such as a table-top or a wall. Any suitable tamper evident band or other device may be employed to prevent accidental actuation of the piercer cover.

In one aspect, by rotating the piercer cover, the threads on the piercer cover engage with the threads on the shell. In this aspect, the piercer cover can be actuated, and the piercers move toward and break the film. In another aspect, the one or more piercers break the area of film closest to the top wall of the piercer cover first, and then break the area of film furthest from the top wall of the piercer cover. In yet another aspect, the one or more piercers break the area of film closest to the top wall of the piercer cover during actuation, but do not break the area of film furthest from the top wall of the piercer cover, so that the film stays attached to the shell.

In one aspect, by rotating the piercer cover, the locks on the piercer cover engage with the locks on the shell, so that the shell rotates when the piercer cover is rotates. In another aspect, by rotating the piercer cover, the beads on the piercer cover engage with the locks on the shell, and the opening between one or more side walls of the piercer cover and the one or more side walls of the shell is sealed.

In yet another aspect, the piercer cover comprises two sets of locks disposed on one or more side walls, with one set of locks disposed closer to the top wall of the piercer cover than the other set of locks, and the shell comprises one or more locks disposed on one or more side walls, so that by actuating the piercer cover, one set of locks on the piercer cover passes one or more locks on the shell, and the vertical range of motion of the piercer cover is limited. Continued actuation of the piercer over results in another set of locks on the piercer cover passing one or more locks on the shell, with one or more side walls of the shell flush against the top wall of the piercer cover, effectively locking, in this aspect, the vertical position of the cover piercer with respect to the shell. Since such vertical relative motion, in this aspect, is no longer possible, rotational motion now results in the shell and piercer cover rotating as one locked unit. In this aspect, the cap device as a whole can be screwed or unscrewed from the mouth of the container.

In another aspect, the one or more side walls of the piercer cover comprise rotation locks, and the one or more locks on the side walls of the shell comprise rotation locks, and when the piercer cover is rotated, the rotation locks on the piercer cover engage with the rotation locks on the shell, so that rotational movement is limited by the piercer cover with respect to the shell. Continued rotation can permit the cap device as a whole to be tightened around the mouth of a container. In another aspect, continued rotation can permit the cap device as a whole to be removed from the mouth of a container.

In one aspect, one or more piercers facilitate removal of the composition from the shell by, for example, rotatably "sweeping" the interior of the shell when the piercer cover is rotatably actuated into the shell and the film is broken.

The container can be filled with any suitable liquid, such as water, juice, or soda. The liquid-filled bottle can be agitated after actuation so the composition is sufficiently mixed into the liquid. In one aspect, the piercer cover can be removed to permit consumption or use of the beverage without removal of the cap device.

BRIEF DESCRIPTION OF THE DRAWINGS

The features and nature of the present disclosure will become more apparent from the detailed description set forth below when taken in conjunction with the accompanying drawings in which reference characters identify corresponding items.

DETAILED DESCRIPTION

The disclosed methods and devices below may be described both generally as well as specifically. It should be noted that when the description is specific to an aspect, that aspect should in no way limit the scope of the methods and devices.

Figure 1:
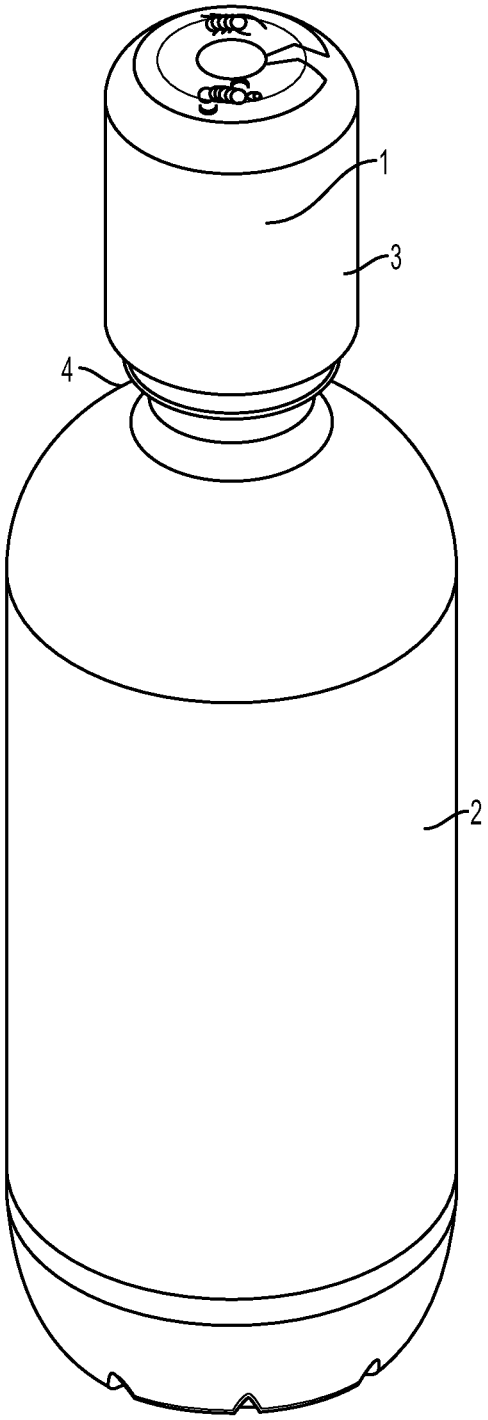
FIG. 1 shows a side view of an exemplary cap device 1 and a container 2.

FIG. 1 is a side view of an exemplary cap device 1. Cap device 1 comprises a piercer cover 3 and a shell 4. Shell 4 may be adapted to attach to the mouth of a container 2.

Figure 2:
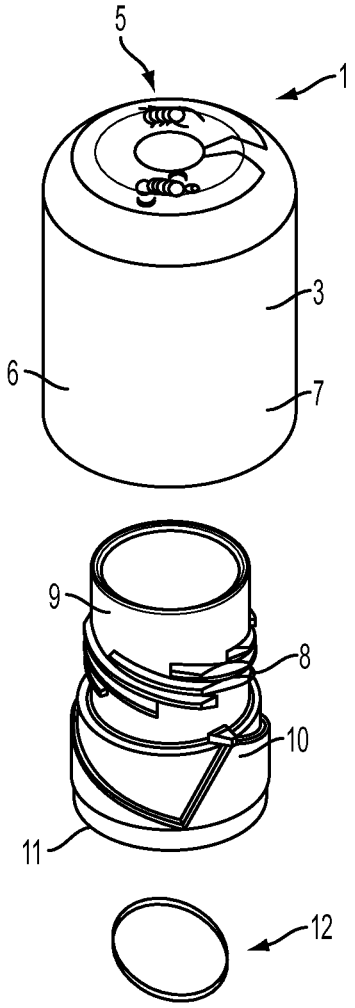
FIG. 2 shows an exploded side view an exemplary cap device 1.

FIG. 2 is an exploded side view of exemplary cap device 1. Piercer cover 3 comprises a top wall 5 and one or more side walls 6. Piercer cover 3 comprises a cover skirt 7. Shell 4 has threads 8 disposed on one or more side walls 9 for adaptably attaching to the mouth of a container 2. Shell 4 has one or more locks 10 disposed on one or more side walls 9. A bottom portion 11 of shell 4 may be covered by a film 12.

Figure 3:
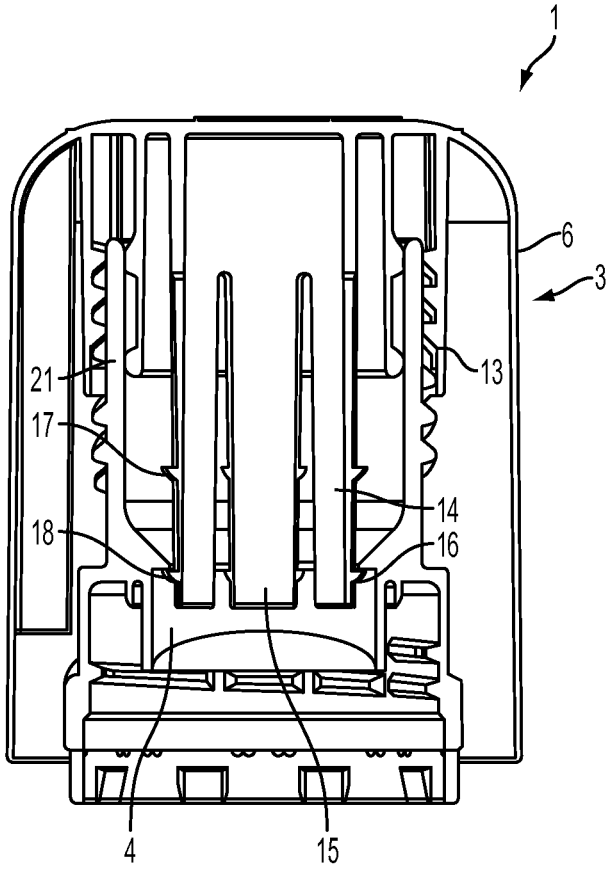
FIG. 3 shows a sectional side view of an exemplary cap device 1.

FIG. 3 is a sectional side view of exemplary cap device 1. Piercer cover 3 has threads 13 disposed on one or more side walls 6. One or more side walls 6 of piercer cover 3 comprise one or more piercers 14. The distal ends of one or more piercers 14 comprise one or more cutting elements 15. Piercer cover 3 has locks 16 disposed on one or more side walls 6. Piercer cover 3 includes an upper set of locks 17 and a lower set of locks 18. Piercer cover 3 further comprises sealing rings 21, which can press or seal the one or more walls of piercer cover 3 from the one or more walls of shell 4. Piercer cover 3 has one or more beads (not shown), which may press or seal the one or more walls of piercer cover 3 from the one or more walls of shell 4.

Figure 3A:
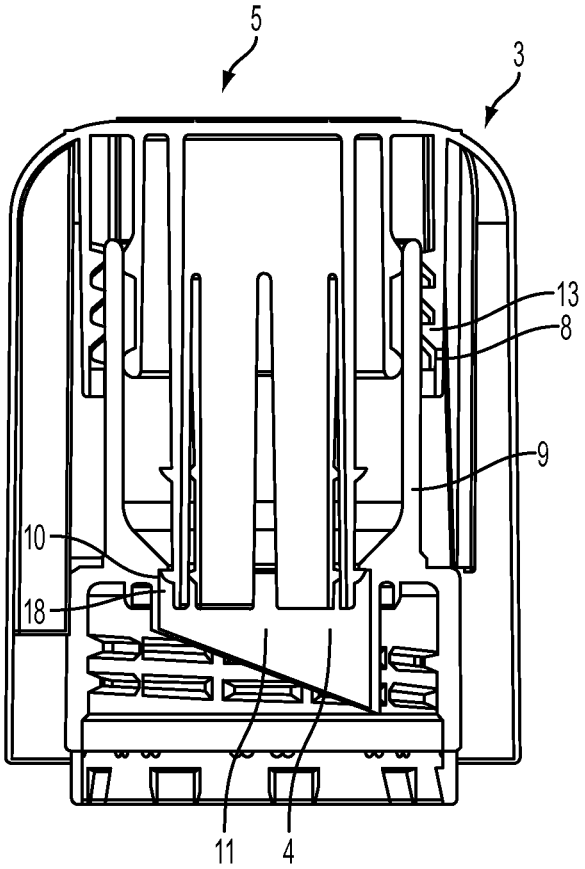
FIG. 3A shows a sectional side view of an exemplary cap device 1.

As shown in FIG. 3*a*, bottom portion 11 of shell 4 may be sloped, so that there is an area closer to top wall 5 of piercer cover 3, and an area furthest from top wall 5 of piercer cover 3. Shell 4 may have threads 8 disposed on one or more side walls 9 for engaging threads 13 of piercer cover 3. As shown in FIG. 3*a*, actuation has not yet occurred—threads 13 of piercer cover 3 have not yet engaged the threads 8 of shell 4. The lower set of locks 18 of the piercer cover 3 have passed locks 10 on shell 4, limiting the range of vertical motion made by piercer cover 3 with respect to shell 4. However, piercer cover 3 can still be moved up and down to a degree.

Figure 4:
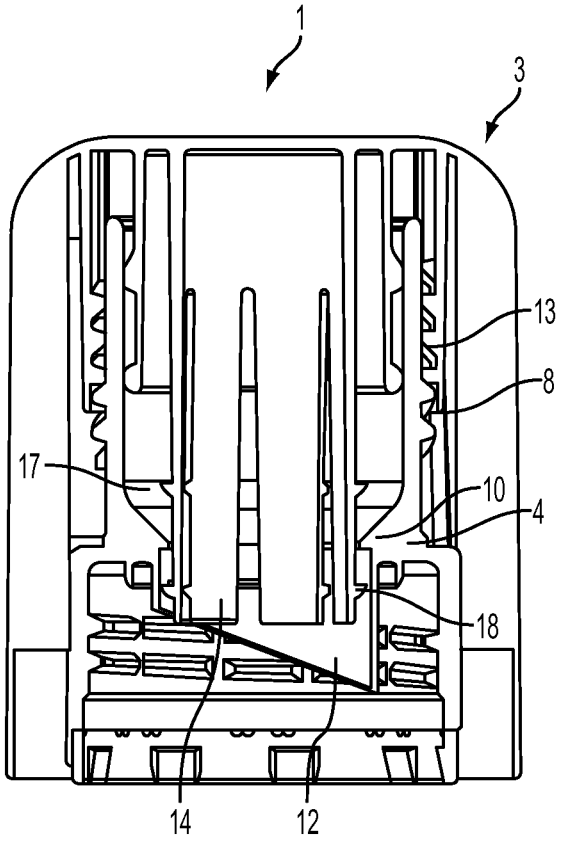
FIG. 4 shows a sectional side view of an exemplary partially actuated cap device 1.

FIG. 4 is a sectional side view of a partially actuated exemplary cap device 1. As shown in FIG. 4, threads 13 on piercer cover 3 have engaged threads 8 on shell 4, and piercers 14 have moved down toward film 12 but have not yet broke the film 12. The lower set of locks 18 of piercer cover 3 have passed locks 10 on shell 4 but the upper set of locks 17 have not.

Figure 5:
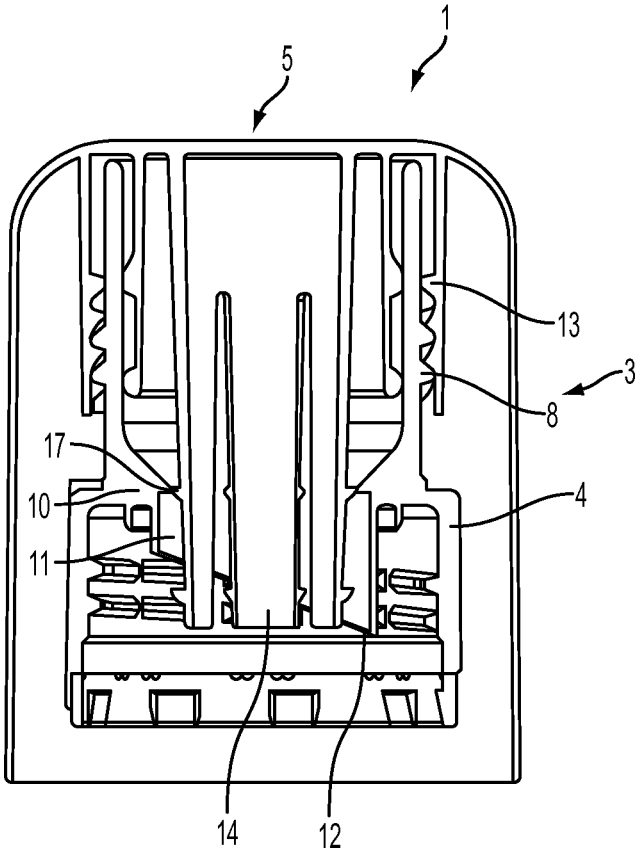
FIG. 5 shows a sectional side view of an exemplary actuated cap device 1.

FIG. 5 is a sectional side view of actuated exemplary cap device 1. As shown in FIG. 5, threads 13 on piercer cover 3 have engaged threads 8 on shell 4, piercers 14 have moved down toward film 12 and broken film 12. The upper set of locks 17 of piercer cover 3 are touching locks 10 on shell 4. The cut-away section of the film 12 is still attached to the bottom portion 11 of shell 4 by film 12 covering the area of bottom portion 11 furthest from top wall 5 of piercer cover 3.

Figure 6:
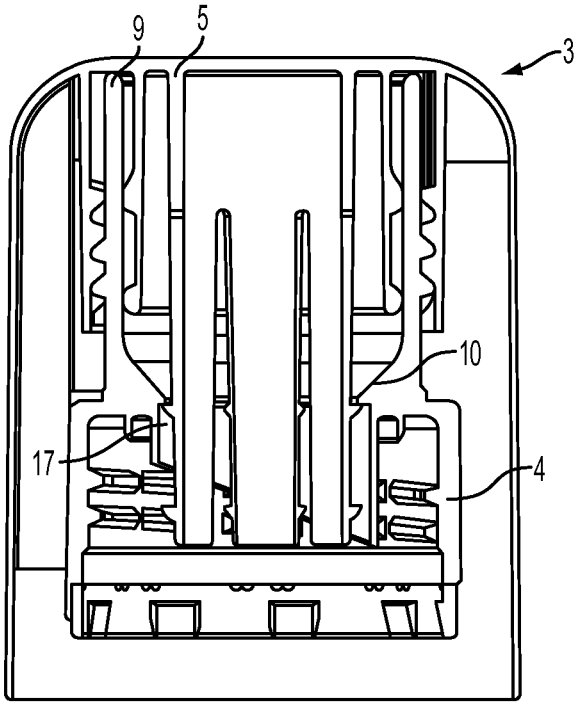
FIG. 6 shows a sectional view of an exemplary actuated "locked" cap device 1.

In FIG. 6, the upper set of locks 17 have passed locks 10 on shell 4, and because one or more side walls 9 of shell 4 are flush against top wall 5 of piercer cover 3, shell 4 and piercer cover 3 are now locked together and vertical motion is limited by one in relation to the other. Since such vertical relative motion is no longer possible, rotational motion now results in shell 4 and piercer cover 3 rotating as one locked unit, and cap device 1 as a whole can be screwed or unscrewed from the mouth of container 2.

Figure 7:
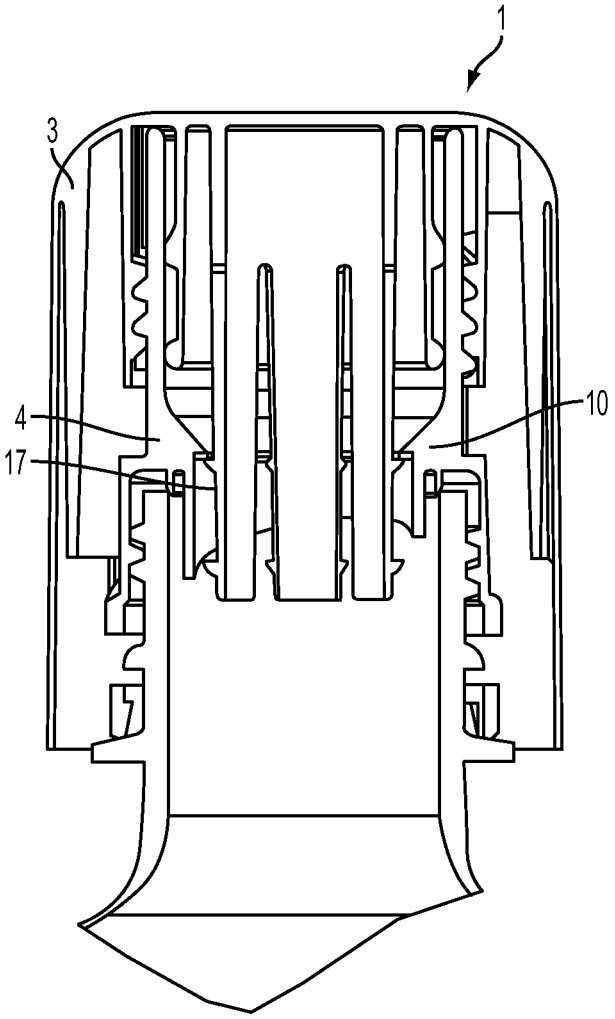
FIG. 7 shows a sectional view an exemplary actuated "locked" cap device 1; being removed from a container 2.

FIG. 7 is a sectional side view of actuated exemplary cap device 1. As shown in FIG. 7, upper set of locks 17 have passed locks 10 on shell 4, so that piercer cover 3 and shell 4 are locked vertically together. As shown in FIG. 7, cap device 1 is being unscrewed by disengaging threads 8 on shell 4 from the threads on container 2.

Figure 8:
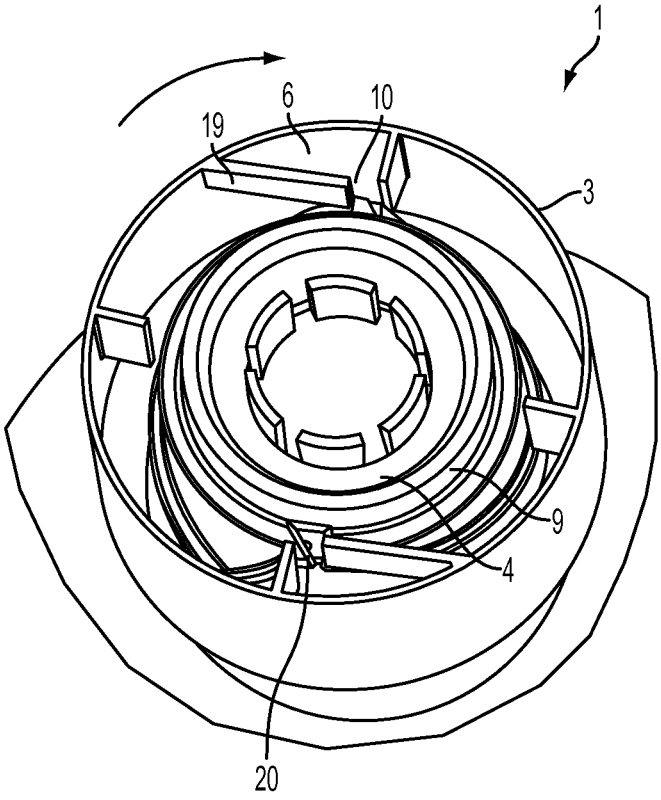
FIG. 8 shows a sectional aerial view of the automatic bottling of an exemplary cap device 1.

FIG. 8 shows a sectional aerial view of the automatic bottling of exemplary cap device 1. One or more side walls 6 of piercer cover 3 comprise rotation locks 19, and one or more locks 10 on side walls 9 of shell 4 comprise rotation locks 20, and when piercer cover 3 is rotated, rotation locks 19 on the piercer cover 3 engage with rotation locks 20 on shell 4, so that no more rotational movement is possible by piercer cover 3 with respect to shell 4. Continued rotation will permit the cap device 1 as a whole to be tightened around the mouth of container 2. In another aspect, continued rotation will permit cap device 1 as a whole to be removed from the mouth of container 2.

What is claimed as new and desired to be protected by Letters Patent of the United States is:

1. A cap device adapted for use with a container comprising:

a piercer cover comprising one or more side walls, a top wall, and a bottom portion, wherein the one or more side walls comprise one or more piercers attached to the top wall and disposed toward the bottom portion of the piercer cover; and a shell for containing a composition comprising one or more side walls, and a sloped bottom portion, wherein the sloped bottom portion forms an opening that is covered by a film wherein the piercer cover further comprises locks disposed on one or more side walls of the piercer cover, and the shell further comprises locks disposed on one or more side walls of the shell.

2. The cap device of claim 1, wherein the piercer cover further comprises two sets of locks disposed on one or more side walls of the piercer cover, and the shell further comprises one or more locks disposed on one or more side walls of the shell, wherein a first set of locks disposed on one or more side walls of the piercer cover is disposed closer to the top wall of the piercer cover than a second set of locks disposed on one or more side walls of the piercer cover.

3. A method of adding at least a portion of a composition to a container, comprising:

providing a piercer cover comprising one or more side walls, a top wall, and a bottom portion, wherein the one or more side walls comprise one or more piercers attached to the top wall and the piercers are disposed toward the bottom portion of the piercer cover;

providing a shell comprising a composition, one or more side walls, and a bottom portion, wherein the bottom portion forms an opening that is covered by a film; and actuating the piercer cover so that the one or more piercers move toward the bottom portion of the shell and break the film, wherein the composition can move from the shell into the container;

wherein the piercer cover further comprises beads disposed on the one or more side walls of the piercer cover, and the shell further comprises locks disposed on the one or more side walls of the shell, wherein by rotating the piercer cover, the beads on the piercer cover engage with the locks on the shell and the shell rotates when the piercer cover is rotated.

4. The method in claim 3, wherein the shell further comprises rotation locks disposed on the one or more side walls of the shell, and the one or more side walls of the piercer cover comprise rotation locks, wherein the rotation locks of the piercer cover engage with the rotation locks on the shell and the shell rotates when the piercer cover is rotated.

5. A cap device adapted for use with a container comprising:

a piercer cover comprising one or more side walls, a top wall, and a bottom portion, wherein the piercer cover has one or more piercers attached to the top wall and disposed toward the bottom portion of the piercer cover, wherein the one or more of the side walls comprises locks and threads; and a shell for containing a composition, comprising one or more side walls, and a sloped bottom portion, wherein the sloped bottom portion forms an opening that is covered by a film, and the one or more of the side walls comprises locks and threads and wherein the locks on the piercer cover are adapted to engage with the locks on the shell, and the threads on the piercer cover are adapted to engage with the threads on the shell.

6. A method of adding at least a portion of a composition to the container in claim 5, wherein a first area of the sloped bottom portion is closer to the top wall of the piercer cover and a second area of the sloped bottom portion is further from the top wall of the piercer cover and wherein the one or more piercers cut a portion of the film covering the first area before a portion of the film covering the second area.

7. The method of claim 6, wherein the film covering the second area is not substantially cut, and the film stays connected to the shell after actuation of the piercer cover.

8. A method of adding at least a portion of a composition to the container in claim 5, wherein the piercer cover further comprises a first set of locks disposed closer to the top wall of the piercer cover than a second set of locks and the shell further comprises one or more locks disposed on the one or more side walls of the shell, wherein the vertical range of motion of the piercer cover is limited when the piercer cover is actuated and the first set of locks passes the one or more locks on the shell.

* * * * *